United States Patent [19]

Ackmann

[11] Patent Number: 4,797,111

[45] Date of Patent: Jan. 10, 1989

[54] TERMINAL FOR SIDE-MOUNT BATTERY

[76] Inventor: Martin E. Ackmann, 851 Bode Rd., Elgin, Ill. 60120

[21] Appl. No.: 45,532

[22] Filed: May 4, 1987

[51] Int. Cl.[4] ..... H01R 11/01

[52] U.S. Cl. ..... 439/755; 439/766

[58] Field of Search ..... 439/754–758, 439/760, 765, 766, 768, 770, 771, 810, 813–815, 886

[56] References Cited

U.S. PATENT DOCUMENTS

| | | | |
|---|---|---|---|
| 1,794,757 | 3/1931 | Cutler | 439/757 |
| 2,370,227 | 2/1945 | Bruder | 439/758 |
| 3,775,730 | 11/1973 | Rowls et al. | 439/755 |
| 3,821,694 | 6/1974 | Gottlieb | 439/755 |
| 3,992,075 | 11/1976 | Cannarsa | 439/755 |
| 4,191,445 | 3/1980 | Deal | 439/886 |
| 4,377,317 | 3/1983 | Shekel et al. | 439/755 |
| 4,390,232 | 6/1983 | Jamgotchian | 439/755 |
| 4,643,511 | 2/1987 | Gawlik et al. | 439/766 |
| 4,691,980 | 9/1987 | Sandor | 439/755 |

*Primary Examiner*—Gil Weidenfeld
*Assistant Examiner*—Paula A. Austin
*Attorney, Agent, or Firm*—Charles F. Lind

[57] ABSTRACT

The disclosed battery terminal bolt is of a unitary assembly, having an elongated threaded stem terminating at an englarged body or head, and a plurality of arms rigidly projected radially from the body or head at a location axially spaced from the threaded stem. The arms may be angled slightly out of perpendicular relative to the threaded stem, in a direction axially away from the threaded stem; or may be perpendicular relative to the threaded stem. The arms provide convenient places to allow for the temporary and separable connection of alligator clamps of a jump cable. The bolt may be formed of separate components secured together, including one component having the head and threaded stem, and one component having the arms. The unitary bolt assembly may be copper plated for improved conductivity.

17 Claims, 1 Drawing Sheet

FIG. 1
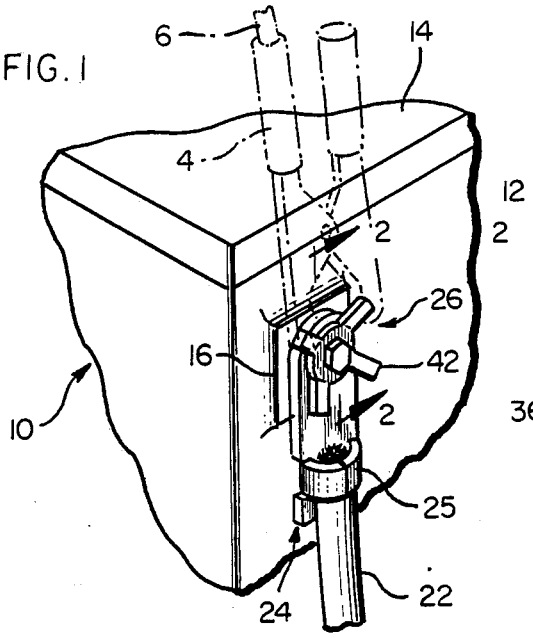
FIG. 5
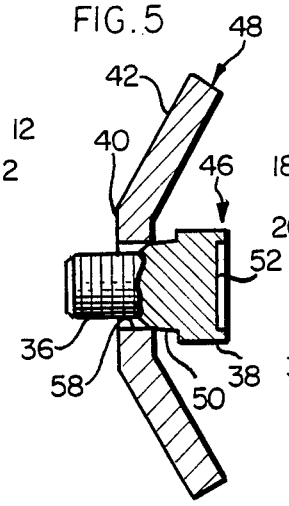
FIG. 2
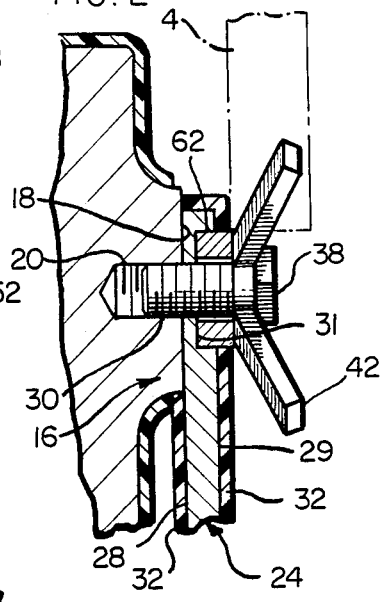
FIG. 3
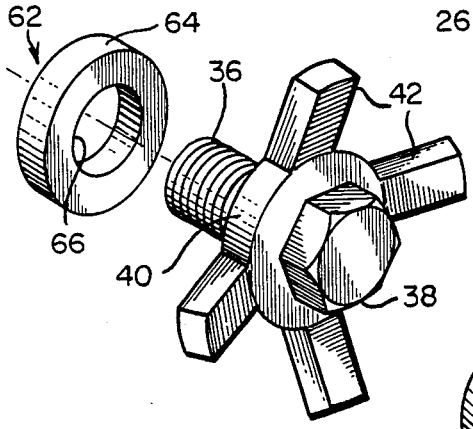
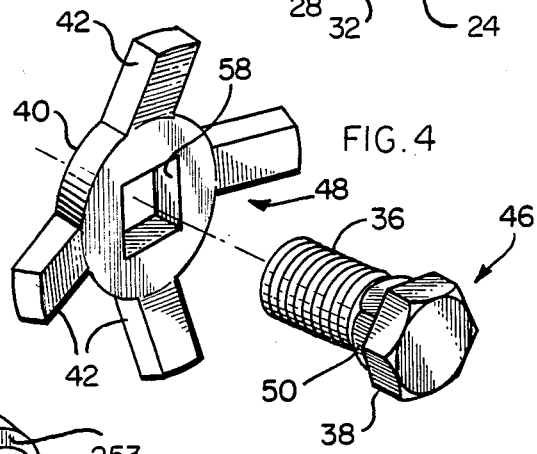
FIG. 4
FIG. 8
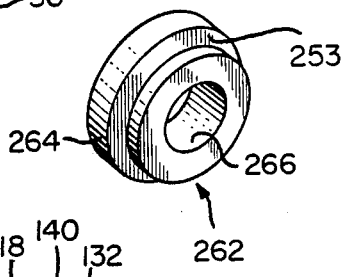
FIG. 7
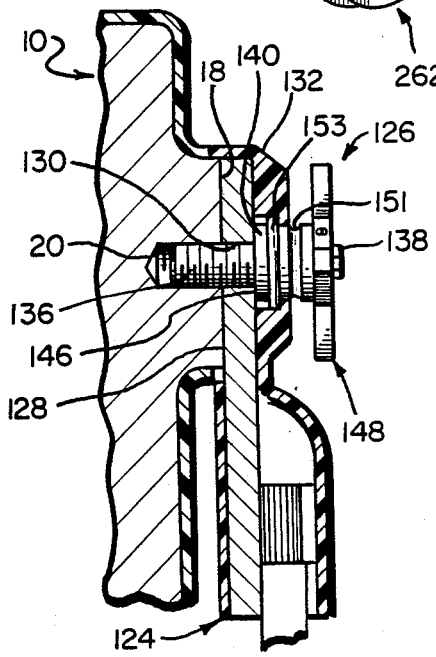
FIG. 6
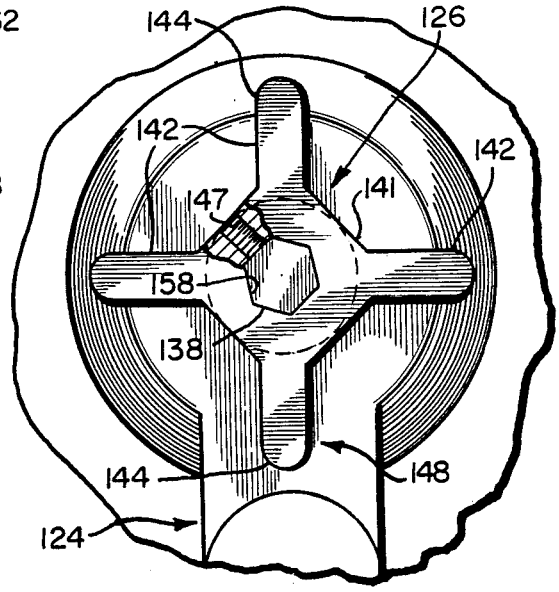

TERMINAL FOR SIDE-MOUNT BATTERY

FIELD OF THE INVENTION

This invention relates to a terminal for use on a side-mount battery, such as is now common in the automotive industry, where the positive and negative battery terminals are located on one side of the battery case.

BACKGROUND OF THE INVENTION

Electric storage batteries commonly used in many automobiles or motor vehicles have the ground and positive terminals located on the side of the battery; and in this disclosure, such are to be referred to as side-mount batteries. Each terminal has a threaded tap, so a bolt can be fitted through a connector eyelet in a battery cable and be threaded into the tap, to provide a mechanically secure and electrically sound connection between the cable and terminal.

When a primary vehicle battery is low in charge, and/or when the engine itself is under high load starting conditions (such as in cold winter weather), a jump start frequently can be needed and made. In order to do this, a secondary battery or source of electrical power is temporarily connected by jump cables to the battery terminals (or sometimes to the grounded engine frame). Typically, each end of the jump cable has an alligator type clamp to allow for making this temporary and separable connection.

However, it frequently is quite difficult to secure the alligator clamp in place onto the battery terminal bolt of a side-mount battery, because: (1) of tight space constrains next to the battery; and moreover (2) typical side mount battery terminals are quite small and have little structure to clamp onto. Thus, the alligator clamp of the jump cable frequently may be unstable, and quite readily can slip off the terminal bolt.

The consequences of a battery cable clamp coming off the battery terminal can be quite devastating, should the cable clamp be live and complete a short circuit against any grounded portion of the vehicle frame or engine, and/or be the ground and complete a short circuit against the live other cable. This would create a dead short, with accompanying intense arcing; and such potentially could be very damaging and/or dangerous.

SUMMARY OF THE INVENTION

The present invention provides a terminal bolt for securing a vehicle battery cable in place against the battery terminal of a side-mount battery, the bolt having an improved configuration to accept an alligator clamp of a jump cable to allow the clamp to be releasably but securely fastened onto the battery terminal bolt.

The improved terminal bolt is unitary, having an enlarged head or body, an elongated threaded stem projected away from the head or body, and a plurality of arms rigidly projected radially from the head or body at a location axially spaced from the threaded stem.

The head or body and threaded stem, and the arms, may be formed initially of separate components, being secured together to define the unitary assembly. The arms may be formed as part of a disc-like component having a central opening, adapted to be press-fitted or otherwise locked nonrotatably in place on a shank or post of the head and threaded stem component.

The unitary assembly, after being formed, may be plated with an electrically conductive material, such as copper or a copper alloy.

The arms may be angled slightly out of being perpendicular to the threaded stem, in a somewhat conical manner axially away from the threaded stem; or may be perpendicular relative to the threaded stem.

The head may define an exposed hex configuration, located on the opposite side of the arms from the threaded stem, to allow a wrench to be used to tighten and/or loosen the terminal bolt relative to the battery terminal.

Four such radial arms may be provided, at 90° spacing from one another.

BRIEF DESCRIPTION OF THE DRAWINGS

Further features and advantages of the present invention will appear from the following disclosure and description, including the accompanying drawing as a part thereof, in which:

FIG. 1 is a perspective view of a typical side-mount battery, showing a vehicle battery cable secured in place thereto by an improved battery terminal bolt formed according to this invention; and further showing in phantom a separable jump cable alligator clamp releasably secured in place on the improved battery terminal bolt;

FIG. 2 is a sectional view, taken generally along line 2—2 in FIG. 1;

FIGS. 3 and 4 are enlarged perspective views of the improved battery terminal bolt of FIG. 1, illustrated by itself; where:

FIG. 3 shows the battery terminal bolt fabricated as a unitary assembly, and FIG. 4, shows the separate components of the battery terminal bolt in a pre-fabricated condition;

FIG. 5 is a somewhat enlarged sectional view, similar to FIG. 2, except illustrating the separate components of the battery terminal bolt is a pre-fabricated condition;

FIG. 6 is an elevational view of a second embodiment of an improved battery terminal bolt connected to a typical side-mount battery, and showing a portion in section;

FIG. 7 is a sectional view of the battery terminal and battery terminal bolt of FIG. 6; and FIG. 8 is perspective views of a spacer that may be used with the battery terminal bolts disclosed herein.

DETAILED DESCRIPTION OF ILLUSTRATED EMBODIMENTS

FIG. 1 shows part of a typical side-mount automotive battery 10 having positive and negative (or ground) terminals located on one side 12 of the battery case, near the upper face or side 14. As the positive and ground terminals are basically of the same exterior construction, only one terminal 16 is illustrated herein. The battery terminal 16 has a substantially flat contact face 18, and a threaded tap 20 generally centered within the contact face 18. The contact face 18 and tap 20 will be formed of electrically conductive material; and while the same is not illustrated, some form of conventional conductor electrically connects them to the positive (or negative) battery plates, so they will be at the same electrical potential (either positive or ground).

When the battery 10 is used in a vehicle, a flexible battery cable 22 is mechanically and electrically secured at one end to the battery terminal 16, typically by a bolt being fitted through an eyelet or opening in a connector 24 crimped or otherwise secured at 25 onto the end of the cable 22 and being threaded into the battery tap 20. The opposite end (not shown) of the cable 22 is connected to an appropriate electrical component (such as the starter motor) or to the vehicle frame as a ground.

Two forms of cable connectors are illustrated, 24 in FIGS. 1 and 2, and 124 in FIGS. 6 and 7. Also, two types of terminal bolts are illustrated, 26 in FIGS. 1–5 and 126 in FIGS. 6 and 7.

Connector 24 has a rigid metal body with generally flat opposing faces 28 and 29, and with an opening 30 countersunk in from the face 29 and defining a recessed face 31. An insulating overwrap 32 (illustrated in FIGS. 2 only for added clarity of the connector construction) may typically cover the connector 24 and its connection to the cable 22, particularly if the same is to be connected to the positive battery terminal. However, no overwrap 32 exists in the annular region around the opening 30, to have both faces 28 and 31 exposed.

The battery terminal bolt 26 has a threaded stem 36 adapted to be threaded into the terminal tap 20; an exposed hexagonal head 38 at the end of bolt opposite the threaded stem 36; a cylindrical disc-like body 40 between the threaded stem 36 and head 38; and four arms 42 radiating from the disc body 40. The arms 42 are spaced angularly from one another by 90°, and are sloped slightly, out of being perpendicular to the threaded stem, to angle in a conical manner somewhat in an axial direction away from the threaded stem 32. The exposed face 46 of the cylindrical body 40 extends perpendicular to the threaded stem 36.

The specific battery terminal bolt 26 is actually made from several separate pieces or components, for ease of manufacture. Thus, as illustrated in FIGS. 4 and 5, a bolt component 46 and an arm component 48 are used.

The bolt component 46 thus can have the threaded stem 36 and hex head 38 integrally formed thereon at its opposite ends, as well as have a tapered square shank section 50 located immediately adjacent the head 38, and converging at perhaps between 8° and 12° in the direction toward the threaded stem 36. The bolt component 46 can be cold formed from a cylindrical rod (not shown) about the same O. D. as the narrow cross dimension of the enlarged hex-shaped head 38. When the rod is contained in appropriate dies (not shown) and is axially struck, the material reforms to the unitary bolt component 46, including forming the threaded stem 36. The exterior face 52 of the head 38 opposite from the threaded stem 36, may end up dimpled convex somewhat, to provide the additional material needed to flare out the rod to the widest dimension across the points of the hex-shaped head.

The arm component 48 may be formed from a flat piece having a central disc-like cylindrical section or body 40; and a square opening 58 can be formed or stamped in the body. The radial arms 42, formed as unitary parts of the cylindrical section, initially may project in a true radial direction from the section and may be angled to the somewhat conical configuration simultaneously when the opening 58 is formed in the component.

The arm component is adapted to be freely fitted over the threaded stem 36 and then be press fit onto the square tapered shank 50 of the bolt component 46. In this regard, the size of the opening 58 will be larger than the threaded stem 36 but perhaps midway between the maximum and minimum cross section of the tapered shank 50. The square shapes of the opening 58 and of the bolt shank 50 cooperates to non-rotably key the components together, and the slight taper therebetween mechanically retains them together, once they have been forced together.

The bolt and arm components 46 and 48 may be formed of steel, to accept being press fit together, while defining then a structural unitary terminal bolt assembly 26. The bolt and arm components 46 and 48 as individually fabricated can be deburred as needed, while minimizing sharp edges or the like. Moreover, after mechanically forcing the bolt and arm components 46 and 48 together into the unitary terminal bolt assembly 26, the entire assembly can be metal plated with a thin layer of copper or copper alloy, for improving electrical conductivity.

When the terminal bolt 26 is threaded tightly into the tap 20, the contacting faces 18 and 28 establish the electrical flow path between the battery terminal 16 and the connector 24. A washer-type spacer 62, having a cylindrical outer periphery 64 and a central opening 66, is adapted to be positioned in the countersunk opening 30 over the threaded stem 36. The spacer is of sufficient thickness, when bottomed solid between the connector face 31 and the terminal bolt face 46, to hold the bolt face 46 spaced from the insulating overwrap 32. With one or more such spacers 62 positioned between the connector and bolt terminal faces 30 and 46, the bolt terminal 26 can be threaded tightly into the tap 20, without the bolt face 46 binding against or possibly ripping any of the insulating overwrap 32 and/or the threaded stem 36 bottoming in the tap 20 while the connector 24 is still not snugged tightly. The spacer 62 could be of an electrically conductive material, or of an insulating material.

A wrench (not shown) such as a socket, open-end, or box-end wrench, may be keyed onto the hex head 38, to use in tightening and/or loosening the terminal bolt 26 relative to the battery tap 20. Also, although possibly not recommended for fear of loosening the arm component 48 from the bolt component 46, the arms 42 could also be gripped manually or with some tool, to tighten down or loosen the battery bolt.

In FIGS. 6 and 7, the illustrated connector 124 has a rigid metal body with generally flat opposing contact faces 128 and 129, and with a uniform diameter opening 130 therein. An insulating overwrap 132 may cover the cable connector 124 and its connection to the cable 22; again being void in the annular region around the opening 130, to have both faces 128 and 129 exposed.

The side-mount battery terminal bolt 126 illustrated is somewhat of a conventional construction, modified to include one embodiment of the invention. The bolt 126 itself, before the modification, may have a threaded stem 136; a slightly enlarged generally cylindrical body 140 adjacent one end of the threaded stem 136; and a small hex-shaped post 138 projecting axially away from the body 140 and threaded stem 136. The stem 136 may fit through the battery cable connector eyelet opening 130 and be threaded into the terminal tap 20; and the head face 146 then cooperates against the connector face 129, to urge the opposite connector face 128 into good electrical contact with the terminal face 18. The hex post 138 normally would allow for the use of a wrench for tightening and/or loosening the terminal bolt as needed relative to the battery.

An annular groove 151 is formed in the cylindrical body 140, between the threaded stem 136 and the hex head 138; and the edge 2, illustrated in phantom only in FIG. 1, of an alligator clamp 4 would normally be fitted into the groove, to help stablize the jump cable 6 when clamped on the terminal bolt. The axial length of the body would be sufficient normally to have the groove 151 line up axially beyond the insulation 132, to have the groove exposed when the bolt 126 is operably holding the connector against the battery. The bolt body 140 has a radial flange 153 that fits under an annular lip portion of the insulating overwrap 132, to trap the bolt body loosely in place between the connector 124 and insulation 132.

The standard bolt may be modified to provide an improved terminal bolt, by the addition of arm component 148. The arm component 148 has central body 141, with a hex shaped opening 158 therein sized to fit over the hex head 138 of the bolt. A set screw 147 is threaded into a tap in the body section 141, to be driven against one face of the hex head 138, to secure the arm component 148 onto the bolt component 136. The hex shapes of the opening and bolt shank non-rotably key the components together, and the set screw 147 mechanically holds the components together. Four arms 142 are spaced angularly from one another by 90°, extended radially from the central body 141, and perpendicular to the threaded stem 136. The ends of each arm 38 may be rounded as indicated at 144.

Again, the arm component 148 may be formed of steel, and may be copper plated for improved conductivity. It may be secured initially onto the hex head 138 of the standard bolt after the bolt itself were secured in place, holding the connector 124 to the battery terminal. Alternatively, it may be secured to the bolt while both were separated from the battery, and the arms 142 could be gripped manually or with a tool for tightening down or subsequently loosening the battery bolt relative to the battery.

Alternatively, the unitary battery terminal bolt 26 of FIGS. 1–5 may be used with the connector 124 of FIGS. 6 and 7, by using a stepped spacer 262, as illustrated in FIG. 8. Thus, the peripherial surface 264 of the spacer is stepped, defining shoulder 253. The spacer 262 is sized to correspond to the body 140 of the standard bolt, where the shoulder 253 corresponds to the flange 153 and is thus trapped under the overlying lip of insulating overwrap 132. The overwrap 132 typically can be flexed sufficiently to allow the spacer 262 to be positioned under the containing lip. The axial thickness of the spacer, in line with the through opening 266, will thus provide an exposed spacer face against which the bolt face 46 can engage when the bolt is tightened down securely against the connector, without tearing up the insulating overwrap 132 or bottoming the threaded stem 36 prematurely before the connector is mechanically tightened down.

As illustrated in FIG. 1, the permanent or vehicle battery cable 22 typically will extend downwardly from the terminal 16, leaving at least part of the terminal bolt itself exposed and somewhat accessible and free towards the upper edge of the battery. The improved battery terminal bolt 26 (or 126) will operate on the one hand exactly as a standard terminal bolt, to securely hold the battery cable connector 24 (or 124) against the battery terminal 16, with both good electrical and mechanical contact.

Moreover, the equally spaced four arms 42 (or 142) provide a place for an allegator clamp 4 of a jump cable 6 to be mechanically secured or clamped onto. Adjacent pairs of the arms 42 (or ,142) may provide a separation of the order of between 1" and 1½") which is well within the opening range of conventional alligator clamp 4. Under most rotational alignments of the arms, two of the arms will generally be pointing upwardly relative to the center of the battery terminal and the other two will be pointing downwardly in the exact opposite directions. The two upwardly extending bolt arms (see FIGS. 1 and 2) provide ideal seats over which the jump cable clamp 4 can be expanded and secured to, with the jump cable 6 then generally being extended upwardly from the battery terminal, somewhat at a 45° inclination between the same two arms over which the clamp is secured.

In an ideal orientation the terminal bolt illustrated in FIGS. 1 and 2, one pair of adjacent arms may each be extended upwardly at 45°; whereupon the allegator clamp itself when secured onto the same arms, will extend just about straight up. However, slight variations from this ideal orientation will yet provide full accessibility of the arms to the end of the jump cable clamp, for clamping over a pair of adjacent arms.

In one possible worst scenario illustrated in FIGS. 6 and 7, the battery bolt may be aligned with one arm extending straight up from the battery terminal, which may make it difficult for the jump cable clamp to be fitted over it and either of the adjacent sidewardly projected arms. In this orientation, the jump cable clamp would be extended upward at approximately a 45° angle. If space restrains preclude this, the allegator clamp may be fitted securely onto the one vertically disposed terminal arm; and as it is well exposed, will provide for a solid mechanically secure connection to the battery terminal.

It will be noted that the projection of the bolt arms 42 (and 142) in the direction away from the battery face is no greater than the projection of the standard hexed bolt head 38 (or 138) away from the battery. This allows for the improved battery post 26 (or 126) to fit in the same tight fitting or snug space constrains, intended for use with the conventional battery bolt terminal.

While several embodiments of the invention have been illustrated, it is apparent that variations may be made therefrom without departing from the inventive concept. Accordingly, the invention is to be limited only by the scope of the following claims.

What is claimed as my invention is:

1. A battery terminal bolt for a side-mount electrical storage battery, comprising the combination of a bolt having a threaded stem at one end and having an enlarged body at the opposite end;

a plurality of arms rigidly projecting radially from the bolt body at a location spaced from the threaded stem; and said bolt and arms being electrically conductive.

2. A battery terminal bolt according to claim 1, further wherein the arms are angled, at their ends, slightly out of perpendicular relative to the body, in a direction away from the stem.

3. A battery terminal bolt according to claim 1, further having a bolt head formed off of the enlarged body and projected in the direction away from the threaded stem, and further wherein said bolt head has a hex configuration.

4. A battery post according to claim 1, further having said bolt body and arms plated with an electrically conductive material.

5. A battery terminal bolt according to claim 1, further wherein the bolt and arms are formed of separate components secured together, said bolt being formed of a component having a threaded stem and an enlarged body formed at one end of the stem, and a hex bolt head formed off of the body in the direction away from the stem; and said arms being formed as part of a unitary disc-like component having a central body with a hex-shaped opening sized to fit onto said hex bolt head, means to mechanically and nonrotatably secure the arm component to the bolt component at said opening-hex bolt head cooperation.

6. A battery terminal bolt according to claim 1, further wherein there are four of such arms radially extended from the body, at 90° spacing from one another.

7. A battery terminal bolt according to claim 6, further wherein the arms are angled, at their ends, slightly out of perpendicular relative to the threaded stem, in a direction away from the stem.

8. A battery terminal bolt according to claim 7, further wherein the bolt and arms are plated with an electrically conductive material.

9. A battery terminal bolt according to claim 1, further wherein the bolt and arms are formed of separate components secured together, said arms being formed as part of a unitary disc-like component having a non-round opening, and said bolt being formed of a component having a shank of cross-sectional shape similar to the opening, but being tapered from smaller to larger than the opening, adapted to be press-fitted into the opening for establishing a sound mechanical fit nonrotatably holding said components together.

10. A battery terminal bolt according to claim 9, further wherein said tapered shank is of a square cross-sectional shape and said opening is similar, and said shank is tapered between 8° and 12°.

11. A battery terminal bolt for a side-mount electrical storage battery, comprising the combination of a bolt having a threaded stem at one end and having an enlarged body at the opposite end;

four arms rigidly projecting radially from the bolt body at a location spaced from the threaded stem, and at 90° spacing from one another;

the arms being angled slightly out of perpendicular relative to the body, in a direction away from the stem;

a bolt head formed off of the enlarged body and projected in the direction away from the threaded stem, and further wherein said bolt head has a hex configuration; and an electrically conductive material plated over said bolt body and arms.

12. A battery terminal bolt according to claim 11, further wherein the bolt and arms are formed of separate components secured together, said arms being formed as part of a unitary disc-like component having a square opening, and said bolt being formed of a component having a shank of square cross-section, but being tapered from smaller to larger than the opening, adapted to be press-fitted into the opening for establishing a sound mechanical fit nonrotatably holding said components together.

13. A battery terminal bolt according to claim 12, further wherein said shank is tapered between 8° and 12°.

14. A battery terminal bolt according to claim 11, further wherein the bolt and arms are formed of separate components secured together, said bolt being formed of a component having a threaded stem and an enlarged body formed at one end of the stem, and a hex bolt head formed off of the body in the direction away from the stem; and said arms being formed as part of a unitary disc-like component having a central body with a hex-shaped opening sized to fit onto said hex bolt head, and means to mechanically and nonrotatably secure the arm component to the bolt component at said opening-hex bolt head cooperation.

15. A battery terminal bolt according to claim 14, further wherein said means to mechanically and nonrotatably secure the arm component to the bolt component includes a set screw threaded into a tap in said arm component and being adapted to project beyond said component at said opening, to lock against the hex bolt head.

16. A battery terminal bolt for a side-mount electrical storage battery, comprising the combination of a bolt having a threaded stem at one end and having an enlarged body at the opposite end;

a plurality of arms rigidly projecting radially from the bolt body at a location spaced from the threaded stem; and said bolt body and bolt stem and said arms being plated with an electrically conductive material.

17. A battery terminal bolt for a side-mount electrical storage battery, comprising the combination of a bolt having a threaded stem at one end and having an enlarged body at the opposite end;

a plurality of arms rigidly projecting radially from the bolt body at a location spaced from the threaded stem;

further wherein:

there are four of such arms radially extended from the body, at 90 degrees spacing from one another;

the arms are angled, at their ends, slightly out of perpendicular relative to the threaded stem, in a direction away from the stem; and the bolt and arms being plated with an electrically conductive material.

* * * * *